US007802316B2

(12) United States Patent
Hofmann

(10) Patent No.: US 7,802,316 B2
(45) Date of Patent: Sep. 28, 2010

(54) GLOVE WITH IMPROVED NBC PROTECTIVE FUNCTION

(75) Inventor: Marianne Hofmann, Düsseldorf (DE)

(73) Assignee: Blucher GmbH, Erkrath (DE)

( * ) Notice: Subject to any disclaimer, the term of this patent is extended or adjusted under 35 U.S.C. 154(b) by 907 days.

(21) Appl. No.: 11/480,001

(22) Filed: Jun. 30, 2006

(65) Prior Publication Data

US 2007/0000017 A1 Jan. 4, 2007

(30) Foreign Application Priority Data

Jul. 1, 2005 (DE) ..... 10 2005 031 235
Oct. 22, 2005 (DE) ..... 10 2005 050 730

(51) Int. Cl.
*A63B 71/14* (2006.01)

(52) U.S. Cl. ..... 2/161.6; 2/161.7; 2/167; 2/159

(58) Field of Classification Search ..... 2/159, 2/160, 161.1, 161.6
See application file for complete search history.

(56) References Cited

U.S. PATENT DOCUMENTS 348,806 A 9/1886 Whitaker
2,058,221 A * 10/1936 Ferguson ..... 2/168
2,083,684 A * 6/1937 Burke ..... 2/168
3,026,531 A * 3/1962 Holaday ..... 2/167
4,089,069 A * 5/1978 Vistins ..... 2/161.8
4,214,321 A * 7/1980 Nuwayser ..... 2/167
4,526,828 A * 7/1985 Fogt et al. ..... 442/19
4,902,558 A * 2/1990 Henriksen ..... 428/220
5,119,515 A * 6/1992 Altinger ..... 2/457
5,336,555 A * 8/1994 Darras et al. ..... 442/263
6,099,936 A * 8/2000 Kashihara ..... 428/141

(Continued)

FOREIGN PATENT DOCUMENTS

DE 201 21 518 U1 2/2003

(Continued)

OTHER PUBLICATIONS

McCullough et al. "A comparison of standard methods for measuring water vapour permeability of fabrics" in *Meas. Sci. Technology* [Measurements Science and Technology] 14, 1402-1408, Aug. 2003, pp. 1402-1408.

(Continued)

*Primary Examiner*—Katherine Moran
*Assistant Examiner*—Richale L Quinn
(74) *Attorney, Agent, or Firm*—Woodard, Emhardt, Moriarty, McNett & Henry LLP

(57) ABSTRACT

The present invention relates to a glove (1) affording protective function against poisonous and/or noxiant agents, the glove (1) comprising two mutually connected glove sections (2, 3) which are constructed of different materials. The first glove section (2) is formed according to the present invention of a polymer-based material which is at least essentially impervious to chemical poisonous and/or warfare agents or at least retards their passage and is at least essentially gas and water impervious. The second glove section (3) being formed of a textile sheetlike filtering material which prevents or at least retards the passage of poisonous and/or noxiant agents and is at least essentially gas and water vapor pervious. The present invention's glove (1) combines good wear comfort with high protection against highly concentrated poisonous and/or noxiant agents.

20 Claims, 3 Drawing Sheets

U.S. PATENT DOCUMENTS

| | | | | |
|---|---|---|---|---|
| 6,301,715 | B1 * | 10/2001 | Hoffmann | 2/161.8 |
| 7,284,283 | B2 * | 10/2007 | Mack et al. | 2/161.6 |
| 2002/0112272 | A1 * | 8/2002 | Culler et al. | 2/161.6 |
| 2003/0032556 | A1 * | 2/2003 | Ouvry | 502/418 |
| 2003/0236047 | A1 * | 12/2003 | Ramkumar | 442/340 |
| 2004/0123366 | A1 * | 7/2004 | Schorr et al. | 2/69 |
| 2004/0237790 | A1 * | 12/2004 | von Blucher et al. | 96/154 |
| 2005/0076418 | A1 * | 4/2005 | von Blucher | 2/161.6 |
| 2005/0266749 | A1 | 12/2005 | De Ruiter | 442/59 |
| 2006/0143767 | A1 * | 7/2006 | Yang et al. | 2/16 |

FOREIGN PATENT DOCUMENTS

| | | | |
|---|---|---|---|
| DE | 102 61 996 | A1 | 3/2004 |
| DE | 20 2004 001 939 | U1 | 5/2004 |
| DE | 103 54 902 | A1 | 5/2005 |
| EP | 0 167 758 | | 1/1986 |
| WO | WO 01/82728 | A1 | 11/2001 |

OTHER PUBLICATIONS

DIN EN 31 092: 1993 of Feb. 1994 ("Textiles—Physiological Effects, Measurement of Heat and Water Vapor Transmission Resistance under steady state Conditions [sweating guarded-hotplate test]", 9 pgs.

* cited by examiner

GLOVE WITH IMPROVED NBC PROTECTIVE FUNCTION

CROSS-REFERENCES TO RELATED APPLICATIONS

This application claims priority to German Patent Application No. DE 10 2005 031 235.7, filed Jul. 1, 2005, and also claims priority to German Patent Application No. DE 10 2005 050 730.1, filed Oct. 22, 2005, entitled "GLOVE HAVING IMPROVED NBC PROTECTIVE FUNCTION". Both references are expressly incorporated by reference herein, in their entirety.

BACKGROUND OF THE INVENTION

The present invention relates to a glove affording protective function against poisonous and/or noxiant agents, the glove comprising two mutually connected glove sections which are constructed of different materials.

There a whole series of agents which are absorbed by the skin and lead to serious physical noxae. Examples include the vesicatory mustard gas Yellow Cross (Hd) and the nerve gas sarin. In addition to such highly toxic chemical warfare agents there are a large number of further hazardous substances generated in different sectors, for example as a consequence of uncontrolled combustion or in the course of industrial manufacturing operations, for example as intermediate or waste products. Such substances, for example dioxins or the like, can likewise have a high toxic potential, so that people likely to come into contact with such poisons must wear a suitable protective outfit or be protected against these materials by suitable protective materials.

Appropriate protective suits are available to protect the body, especially the extremities and the trunk. The head, especially the face and also the respiratory tract airways are generally protected by wearing NBC protective masks with or without hoods.

But particular protection must also be ensured for the hands in particular, since these can frequently come into contact directly with the aforementioned poisonous or noxiant agents, for example in the course of military deployments, decontamination duties or in the course of work in industrial manufacture. Particular protection for the hands can be ensured by the wearing of protective gloves suitable for tasks including military deployment or NBC deployment in particular.

The air and water tight, nonbreathable rubber gloves utilized in the prior art for military deployment or NBC deployment, but also for decontamination duties and as part of industrial protective clothing are admittedly impervious to toxic chemical agents but have the serious disadvantage of a practically nonexistent breathability and hence of only minimal wear comfort, and this is disadvantageous in particular in the event of prolonged deployments or under physical exertion.

The prior art further features so-called breathable protective gloves as described for example in commonly assigned U.S. Pat. No. 6,301,715 B1 and its equivalent WO 01/82728 A1 and DE 201 21 518 U1. The glove described therein is particularly useful for pilots of combat aircraft, since it combines its protective effect against chemical poisons with enhanced tactility. This glove comprises an activated carbon based adsorbing layer for chemical poisonous and warfare agents which is formed over the entire glove area. This glove does possess high breathability, but is not optimized for protection against extremely high concentrations of noxiant or poisonous agents as arise for example when toxic substances are present in liquid form. Thus, it is not always ensured with this glove that the permeation of noxiant or poisonous agents can be completely prevented under extreme situations, for example on contact with objects highly contaminated with liquid poisons.

Furthermore, commonly assigned DE 103 54 902 relates to a breathable protective glove which, similarly to the aforementioned documents, comprises an adsorbing layer, on the basis of activated carbon for example, extending over the entire glove area, although the protective glove comprises an additional blocking layer which similarly extends over the entire glove area. The envisioned blocking layer is disposed between an adsorbing layer and an outer backing layer based on a textile or leather material. The presence of a blocking layer covering the entire hand does indeed lead to an improved protective effect with regard to chemical poisons or noxiants, but the breathability and hence the wear comfort can be impaired to a certain degree, especially under physical exertion or at high ambient temperatures.

The present invention therefore has for its object to provide a glove which at least partially avoids or at least ameliorates the above described disadvantages of the prior art. More particularly, a glove is to be provided that combines a high protective function against poisons or noxiants with good breathability. A particular objective is that concentrated poisons or noxiants as present for example in highly concentrated liquids, aerosols and the like cannot come into contact with the hand or the skin of the hand. A particular objective here is to avoid such toxic substances coming into contact with the hand's inner surface or the gripping area of the hand when the hand comes into contact or grips and/or holds for example contaminated objects or surfaces.

By way of achievement of the object described above, the present invention proposes a glove for covering a hand's inside surface, a hand's outside surface and fingers, in particular a breathable protective glove (for example military protective glove, NBC protective glove or work glove with NBC protective function) affording protective function against poisonous and/or noxiant agents. Further, advantageous embodiments are disclosed herein and form the subject matter of the dependent claims.

The present invention accordingly provides a glove covering at least a hand's inside surface, a hand's outside surface and the fingers of a wearer, for example of a soldier, industrial worker, decontamination specialist, etc., the glove affording a protective function against poisonous and/or noxiant agents. The glove of the present invention comprises two mutually connected glove sections which are constructed of different materials.

It is particular feature of the glove of the present invention that the first glove section is formed of a polymer-based material which is at least essentially impervious to chemical poisonous and/or warfare agents or at least retards their passage and is at least essentially gas and water impervious and generally also water vapor impervious. Owing to this specific embodiment of the first glove section, which preferably covers the gripping area of the hand, i.e. the hand's inside surface and the inside surface of the fingers including the tips of the fingers, the first glove section in particular is able to keep highly concentrated such as liquid poisons or noxiants away from the hand in an effective manner. The result is an efficacious protection for the wearer of the glove of the present invention, even when the wearer comes into direct contact with highly concentrated or liquid sources of noxiant.

It is a further characteristic of the glove of the present invention that the second glove section is formed of a textile sheetlike filtering material which prevents or at least retards the passage of poisonous and/or noxiant agents and is at least essentially gas and water vapor pervious. It is thus ensured in accordance with the present invention that—owing to the gas and water vapor pervious, i.e. breathable construction of the second glove section, the glove of the present invention additionally possesses as a whole a high wear comfort, so that it is suitable for prolonged deployment, for example under physical exertion or at high temperatures.

In other words, the present invention provides a glove affording protective function against poisonous and/or noxiant agents, the glove comprising two mutually connected glove sections, the glove sections each being formed by at least one piece of material, the pieces of material of the two glove sections each consisting of different materials. The first glove section is formed of at least one first piece of material, the first piece of material consisting of at least one polymer-based material at least essentially gas impervious and water impervious and generally also water vapor impervious and at least retarding the passage of poisonous and/or noxiant agents or at least essentially impervious to chemical poisonous and/or warfare agents. The second glove section is formed of at least one second piece of material, the second piece of material consisting of at least one at least essentially gas pervious and water vapor pervious, i.e. breathable textile sheetlike filtering material, the textile sheetlike filtering material being such that it prevents or at least retards the passage of poisonous and/or noxiant agents.

As mentioned, the first glove section in particular ensures that the glove possesses an excellent protective function against highly concentrated noxiants, in particular in liquid form, while the second glove section ensures a high breathability and hence a high wear comfort on the part of the glove of the present invention as well as a good protective effect against poisonous or noxiant agents. The particular feature of the glove in accordance with the present invention is thus to be seen in particular in the fact that the glove in accordance with the present invention comprises two differently constructed glove sections each having protective properties specifically adapted or tailored to the required performance profile—very high protective potential with regard to the gripping or hand's inner surface on the one hand and high breathability with regards to the less endangered back of the hand side (i.e the dorsal side) on the other—so that altogether an optimal protective performance is achieved on the one hand and a very high wear comfort, in particular an excellent breathability, on the other.

For the purposes of the present invention, "inside surface of the hand" and "inside surfaces of the fingers" refer respectively to the regions of the hand and of the fingers which form the gripping surface of the hand (i.e the palm of a hand), while "back of the hand" and "back surfaces of the fingers" refer to the regions of the hand which are opposite the inside surface of the hand and the inside surfaces of the fingers, respectively, (i.e the dorsal side) and thus do not contribute to forming the gripping surface.

The term "longitudinal sides of the fingers" refers to the sides of the fingers which extend in the longitudinal direction and which are disposed between the inside surfaces of the fingers and the back surfaces of the fingers, i.e. the region between the fingers, as it were.

Furthermore, the term "free ends of the fingers" refers to the finger sections which are formed by the fingertip and the directly adjoining finger regions.

The term "glove" is for the purposes of the present invention preferably understood as meaning such a glove as serves for at least essentially complete coverage of a hand's inside surface, a hand's outside surface and of fingers. The glove preferably has the shape of a hand with five fingers. However, this embodiment of the glove according to the invention is not limiting; it is similarly possible in accordance with the present invention to construct the glove in the shape of a mitten for example. It is similarly possible in accordance with the present invention for pairs of fingers (for example index finger and third finger on the one hand and ring finger and small finger on the other) to be accommodated in a separate finger sleeve or receptacle.

For the purposes of the present invention, the term "front surface"—also referred to by the synonym of "inside surface"—of the glove of the present invention at least refers to those regions of the glove which, in the worn state of the glove, at least essentially cover the hand's inner surface and the inside surfaces of the fingers, or extend therebeyond.

Correspondingly, the term "back surface"—also referred to by the synonym of "outside surface" of the glove of the present invention is to be understood as referring to those regions of the glove which, in the worn state, at least essentially cover the back of the hand or at least essentially extend therebeyond.

The expression "on its inside surface", as used herein, refers to that side or layer of the glove sections which, in the worn state of the glove of the present invention, faces the wearer or is in contact with the wearer or the hand, and further (covering) layers can be present.

Furthermore, the expression "on its outside surface", as used herein, refers to that side or layer of the glove sections which, in the worn state of the glove, faces away from the wearer or is in contact with the environment, and further (covering) layers may cover the side or layer.

Furthermore, the term "front end" of the glove of the present invention refers to the region of the glove which in the worn state covers in particular the fingers and the midhand or hand region, while the term "rear end" refers to the region which in the worn state covers the wrist and the region of the forearm that joins the rest.

Finally, for the purposes of the present invention, the term "poisonous and/or noxiant agents" is to be understood as meaning substances which have toxic properties and which can lead to health defects or serious physical noxae when absorbed by the skin or when they come into contact therewith. Examples include chemical warfare agents, for example the vesicatory mustard gas Yellow Cross (Hd) and the nerve gas sarin. But poisonous and noxiant agents for the purposes of the present invention also include radioactive, biological and chemical substances having toxic potential (for example NBC warfare agents), but also toxic substances as generated in industrial manufacturing facilities for example or substances which are generated in uncontrolled fashion in fires and environmental catastrophes for example. The poisonous and noxiant agents may be present in solid, liquid and/or gaseous form, for example as an aerosol or the like.

Further advantages, features, properties and aspects of the present invention will become apparent from the following description of preferred operative examples with reference to the drawings.

BRIEF SUMMARY OF THE INVENTION

A glove for covering a hand's inside surface, a hand's outside surface and a hand's fingers, the glove affording protective function against poisonous and/or noxiant agents, wherein the glove comprises two mutually connected glove sections, which two glove sections are constructed of different materials, a first glove section being formed of a polymer-based material which is impervious to chemical poisons and warfare agents or at least retards their passage and is gas-impervious and water-impervious, and a second glove section being formed of a textile sheetlike filtering material which prevents or at least retards the passage of chemical poisons and warfare agents and is gas-pervious and water-vapor-pervious.

One object of the present invention is to provide an improved glove affording protection against poisonous and/or noxiant agents.

Related objects and advantages of the present invention will be apparent from the following description.

DETAILED DESCRIPTION OF THE INVENTION

Figures 1A, 1B:
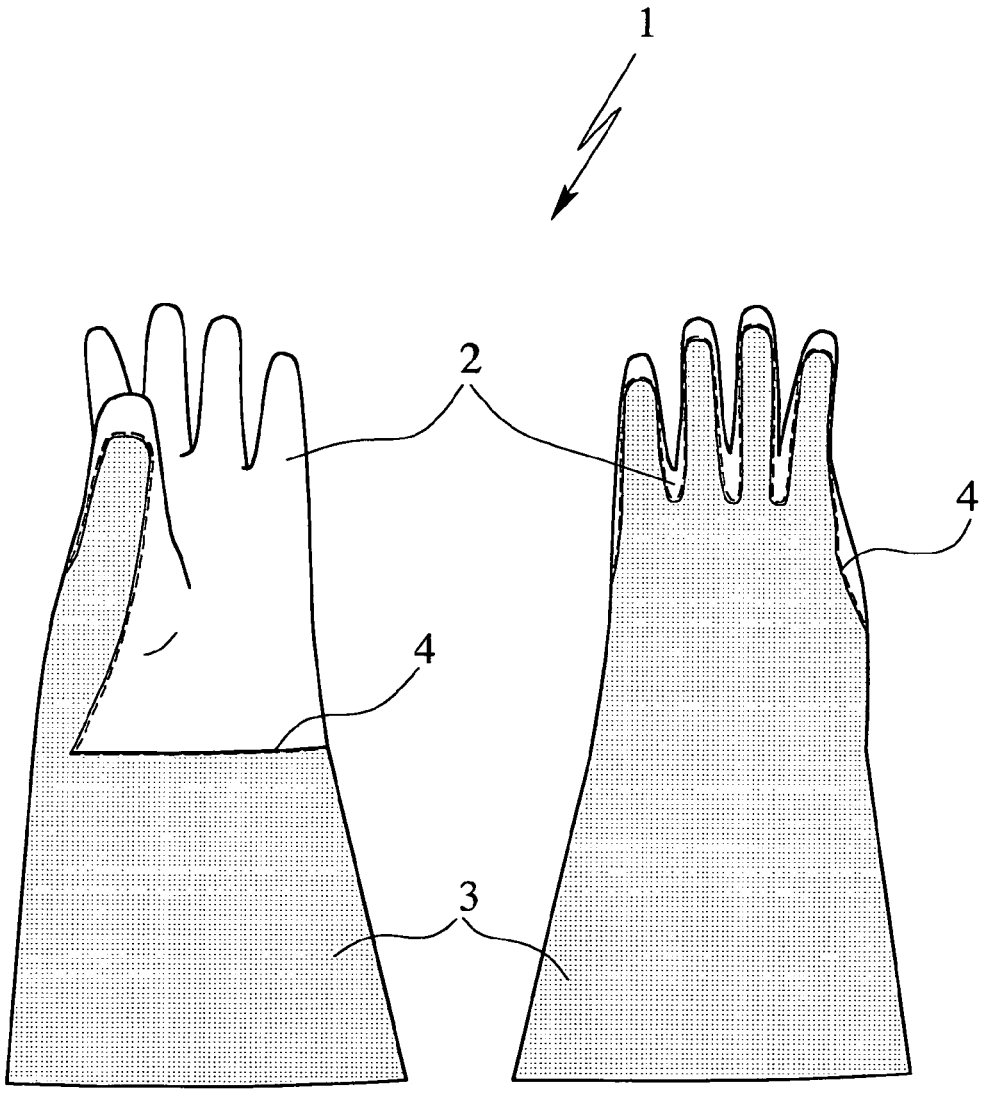
FIG. 1A shows a perspective view of the front or inside surface of the present invention's glove according to a first embodiment of the present invention.
FIG. 1B shows a perspective view of the back or outside surface of the present invention's glove as per FIG. 1A.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the figures, the same reference signs are used for identical or similar parts and corresponding properties and advantages are achieved even though repeated description is omitted for simplicity.

The figures (i.e. FIGS. 1A to 3B) show a present invention's glove 1 for covering a hand's inside surface, hand's outside surface and fingers and affording protective function against poisonous and/or noxiant agents. As FIGS. 1A to 3B further show, the present invention's glove 1 comprises two mutually connected glove sections 2, 3 which are constructed of different materials. The first glove section 2 is formed of a polymer-based material which is at least essentially impervious to chemical poisonous and/or warfare agents or at least retards their passage and is at least essentially gas and water impervious and generally also water vapor impervious. The second glove section 3 is formed of a textile sheetlike filtering material which prevents or at least retards the passage of poisonous and/or noxiant agents and is at least essentially gas and/or water vapor pervious.

Figures 2A, 2B:
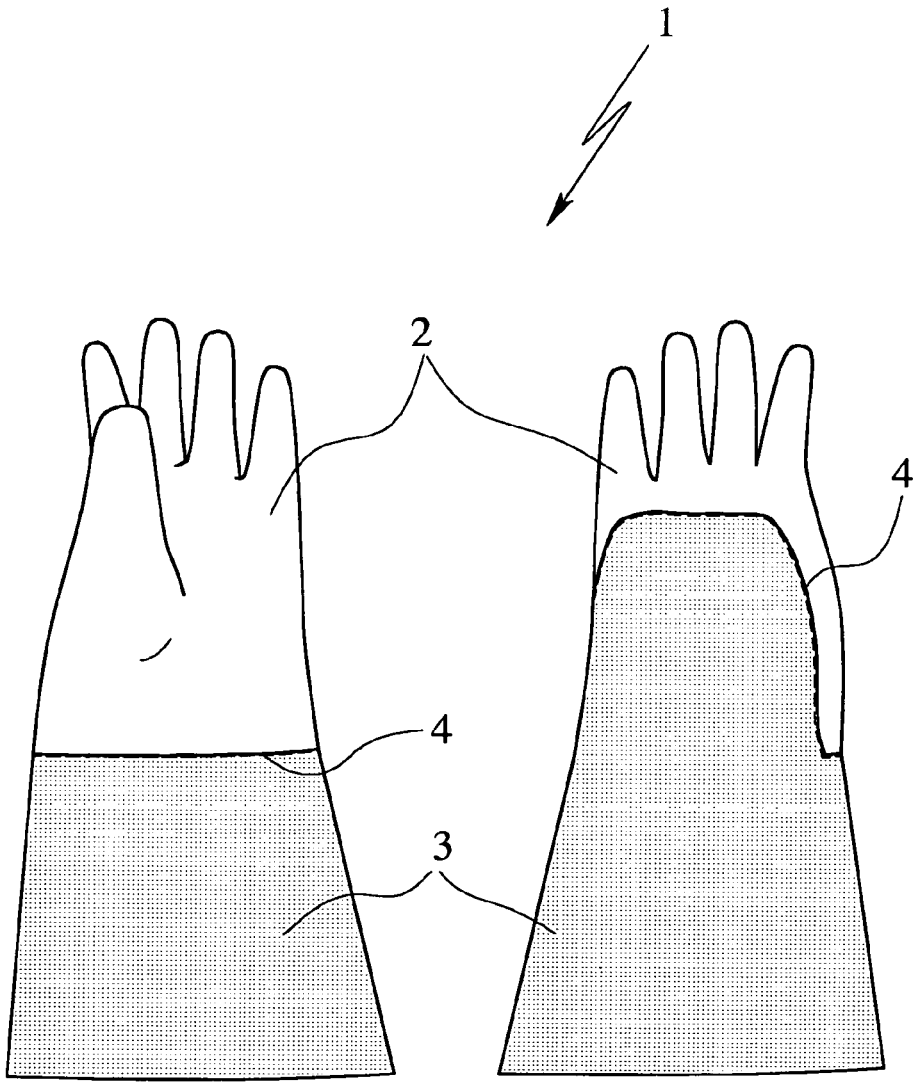
FIG. 2A shows a perspective view of a front or inside surface of the present invention's glove in accordance with a second embodiment of the present invention.
FIG. 2B shows a perspective view of a back or outside surface of the present invention's glove as per FIG. 2A.
Figures 3A, 3B:
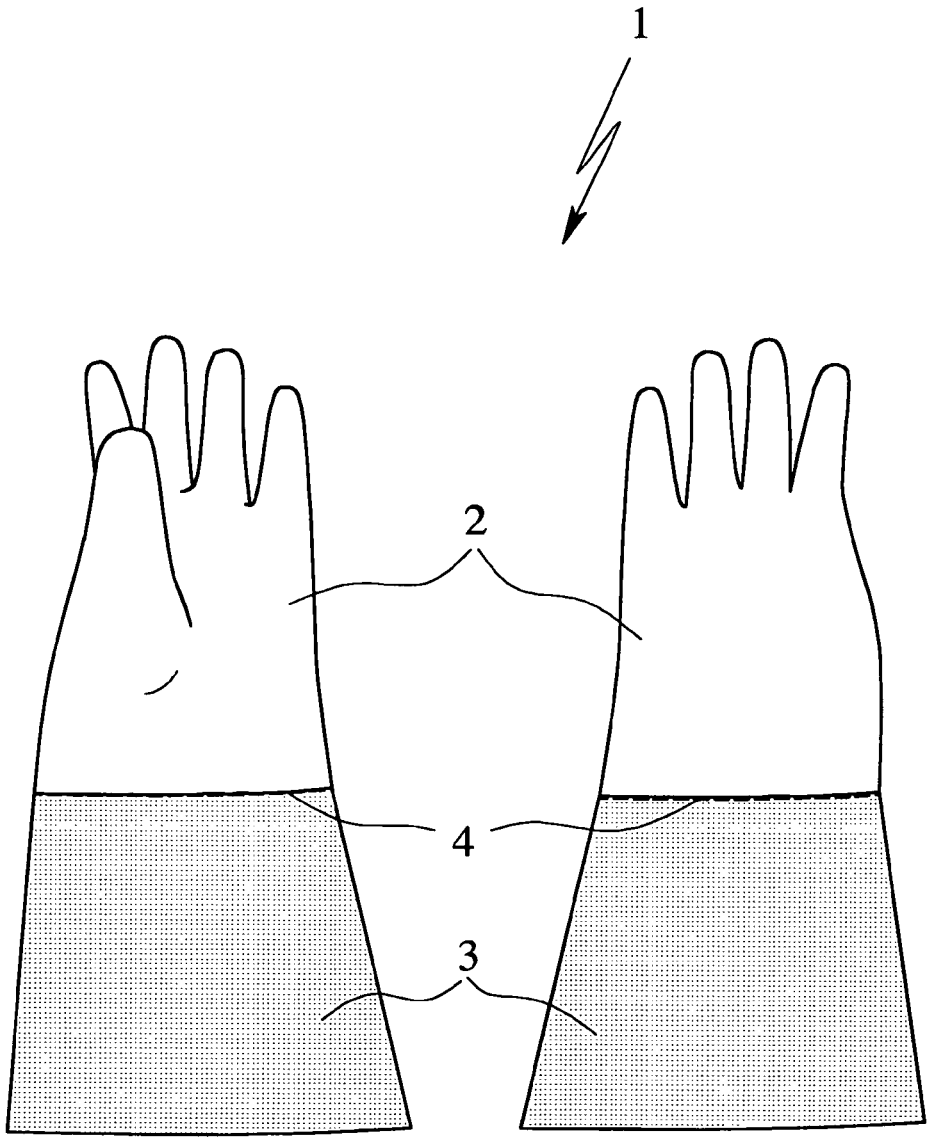
FIG. 3A shows a perspective view of the front or inside surface of the present invention's glove according to a third embodiment of the present invention.
FIG. 3B shows a perspective view of the back or outside surface of the present invention's glove as per FIG. 3A.

FIGS. 1A, 2A and 3A show the present invention's preferred principle that the first glove section 2 of the glove 1 according to the invention is constructed such that it at least essentially completely covers the hand's inside surface and the inside surface of the fingers in the worn state of the glove 1. It is thus ensured in accordance with the present invention that the region of the hand that comes into contact with the poisonous or noxiant agents when gripping or touching objects for example is at least essentially completely covered by the first glove section 2. Thus, the first glove section 2 of the present invention's glove 1 is arranged at the front end of the glove 1, preferably on the front or inside surface of the present invention's glove 1. More accurately, the first glove section 2 extends in the worn state at least essentially completely over the hand's inside surface and the inside surfaces of the fingers. But this is not mandatory, and it is similarly possible to cover only certain regions of the hand's inner surface and of the inner surface of the fingers, for example those of the index finger and of the thumb, with the first glove section 2.

With regard to the first embodiment of the present invention, as per FIGS. 1A and 1B, it can be provided in accordance with the present invention that the first glove section 2 covers the free ends of the fingers over the entire finger circumference in the worn state of the glove 1. Thus, the first glove section 2 can extend whole-circumferentially over the tips of the fingers and enclose them, so that the fingertips are covered in the manner of a thimble. The covering of the fingertips by the first glove section 2 in the worn state of the glove 1 has the effect that even the particularly exposed and hence endangered fingertips are effectively protected from highly concentrated, in particular liquid poisonous and noxiant agents.

As further shown by FIGS. 1A and 1B, it may also be provided in accordance with the present invention that the first glove section 2 covers the fingers to more than half, especially to more than two thirds and more preferably to more than three quarters of the finger circumference in the worn state of the glove 1. It should be ensured in this connection, as previously mentioned, that the inner surfaces of the fingers are similarly covered by the first glove section 2. It may further be provided in accordance with a further aspect of this embodiment that the first glove section 2 covers the longitudinal sides of the fingers at least essentially completely, as is also discernible from FIG. 1B. The covering of the side surfaces of the fingers with the first glove section 2 leads to the advantage that even these regions which—comparable to the fingertips—are in the immediate vicinity of the actual gripping surface of the hand are similarly protected from fairly concentrated or liquid poisonous or noxiant agents. This is because touching a contaminated surface with the hand's inner surface for example also carries with it a certain risk that the longitudinal sides of the fingers can come into contact with the poisonous or noxiant agents.

With regard to the first embodiment as per FIGS. 1A and 1B, the second glove section 3 is such that the backs of the fingers are covered by the second glove section 3 in the worn state of the glove 1. In this first embodiment, the second glove section 3 can thus extend from the front end to the rear end of the back of the present invention's glove 1, preferably up to the fingertips covered by the first glove section 2.

Alternatively, in accordance with other embodiments of the glove 1 according to the present invention, it may also be provided in accordance with the present invention that the first glove section 2 covers the fingers at least essentially completely in the worn state of the glove 1, as is discernible from the second embodiment as per FIG. 2A and from the third embodiment as per FIG. 3A.

In accordance with the second and third embodiments, it can be similarly provided—as shown in FIGS. 2B and 3B—that the first glove section 2 forms at least a portion of the back of the hand in the worn state of the glove 1. In this case, the first glove section 2 covers at least a region of the back of the hand that is adjacent to the fingers. In other words, the first glove section 2 in these embodiments extends completely over the hand's inner surface, the fingers and can also extend therebeyond (cf. FIG. 3B) over the knuckles of the back of the hand or over the entire back of the hand.

In accordance with the second and third embodiments depicted in FIGS. 2B and 3B respectively, the second glove section 3 can be designed such that the second glove section 3 covers the back of the hand or at least a portion of the back of the hand in the worn state of glove 1 (FIG. 2B), preferably the second glove section 3 in this embodiment extends from the rear end of the present invention's glove 1 to the knuckles. If the second glove section 3 covers only part of the back of the hand in the worn state of glove 1, the second glove section 3 is arranged such that it preferably covers at least a region of the back of the hand that is not adjacent to the fingers.

The gas and water vapor perviousness of the second glove section 3 ensures that the present invention's glove 1 altogether offers a very high wear comfort while at the same providing high protection to poisonous or warfare agents. The protective effect is not significantly impaired, since the second glove section 3, being constructed as a textile sheetlike filtering material, likewise prevents or at least retards the passage of poisonous or noxiant agents, so that the less endangered region of the hand, in particular the back of the hand, likewise enjoys effective protection against poisonous and noxiant agents, in particular when these are present in lower concentrations or in gaseous form.

FIGS. 1A to 3B show that the glove of the present invention also comprises a shaft for the wrist or for the forearm section adjoining the wrist. In this regard, the shaft can be configured for example as a cuff which can be placed over further items of clothing, for example a jacket, so that a contamination safe transition between glove 1 and the remaining item of clothing is created as a result. The shaft is situated on the rear end of the glove 1 according to the invention and forms the opening for inserting the hand into the present invention's glove 1.

In a preferred embodiment of the present invention, the shaft is formed by the second glove section 3 only, as is discernible from FIGS. 1A to 3B. However, the shaft may also be at least partially formed by the first glove section 2. In this case, the first glove section 2 should, in the worn state of the glove 1, cover the inner surfaces of the wrist and of the forearm section and thus form the inside surface, as it were, of the shaft. This ensures further protection for the particularly contamination-endangered inner surfaces. The shaft may be modified with means or devices known per se to one skilled in the art. For instance, the shaft may be additionally equipped with a zip which, in the closed state, can reduce the shaft diameter, so that the shaft bears more closely against the wrist and/or the forearm, thereby enhancing security of fit. The glove section 2, 3 underneath the zip can also be continuous in this regard so as not to reduce the protective effect against poisonous or noxiant agents. It may further be provided that for example in the region of the wrist and/or the rear end of the shaft there is—illustratively and nonlimitingly—an elastic means, for example a rubber band or the like, to reduce the diameter at this point, so that the present invention's glove 1 bears particularly closely against the wrist or the forearm in these regions.

The present invention's glove 1 is characterized in that the first glove section 2 and/or the second glove section 3 may each have a one piece construction, so that the present invention's glove 1 preferably consists of two pieces of material only. This leads to a simple construction and hence to a distinct reduction in manufacturing costs. There is the additional advantage that the present invention's glove 1 has only few potential breakthrough points as might be created by pieces of material being stitched together for example.

As FIGS. 1A to 3B further show, the pieces of material are joined together via joins 4. In this context, the first glove section 2 and the second glove section 3 can be nonlimitingly stitched, adhered, welded together and the like, including the possibility of a plurality of forms of joining being concurrently realized in the join 4, as in the case of stitching and welding for example. What is decisive here is that the joins 4 are at least essentially sealing.

The material of the first glove section 2 is essentially pore free and/or aperture free and/or continuous. These properties ensure that the first glove section 2 is at least essentially impervious to chemical poisons or warfare agents or at least retards their passage and is at least essentially gas and water impervious and at least generally also water vapor impervious, so that a high protective effect with regard to highly concentrated poisonous or noxiant agents is present, in particular when they occur in liquid form. In other words, the first glove section 2 acts as a blocking layer for poisonous or noxiant agents, since they are unable to pass through the first glove section 2 or the material of the first glove section 2.

The material of the first glove section 2 may comprise at least one rubber, i.e. a natural or synthetic rubber, in particular a modified rubber or consist thereof. In a particularly preferred embodiment of the present invention, the material of the first glove section 2 comprises or consists of butyl rubber. But chloroprene rubbers, such as neoprenes or fluororubbers may also be used. It is further possible to use fluoroelastomers, such as Viton®.

In accordance with a particular embodiment, it is possible to form the first glove section 2 by combining two or more of the aforementioned polymers with one another, for example rubber on the one hand and fluoroelastomers on the other, in which case this is preferably accomplished in a layered construction (i.e. the individual layers form a continuous bonded system wherein each layer may comprise a different polymer from the adjacent layer). For this purpose, for example, the material of the first glove section 2 may be constructed with a multilayered construction, in particular with an at least two layered construction and preferably with an at least three layered construction ("sandwich construction"), in which case, in a preferred embodiment, at least one layer contains or consists of an optionally modified rubber, in particular an optionally modified butyl rubber, and at least one other layer, which is preferably disposed adjacent to the rubber-containing layer, contains or consists of a fluoroelastomer, such as Viton®.

The first glove section 2 may preferably additionally comprise on its inside surface a textile fabric, in particular a woven, loop-formingly knitted, loop-drawingly knitted, laid, bonded, batty or nonwoven fabric. The textile fabric may optionally also be attached on the outside surface. It may serve not only to enhance the wear comfort, in particular if it is applied on the inside surface, but also contribute to an additional strengthening of the first glove section 2.

It may further be provided that the first glove section 2 be provided on its inside surface with a material improving the wear comfort, such as polyamide and/or viscose. This can be effected for example in the course of a flocking treatment. The providing or investment with the aforementioned materials leads to an enhanced wear comfort, since, first, the haptics are improved and, secondly, the invested or provided material is preferably capable of taking up perspiration.

The second glove section 3 or the textile sheetlike filtering material of the second glove section 3 may comprise respectively a textile fabric or any desired textile material that is air pervious/breathable or water vapor pervious. Nonlimiting examples are wovens, formed-loop knits, drawn-loop knits, laids, bondeds, batts or nonwovens. In accordance with the present invention, it is also possible to use a reversibly extensible or an elastic textile fabric, for example to improve the fit of the present invention's glove 1. Elastic textile fabrics are known as such to one skilled in the art. It is particularly advantageous for the textile fabric to be extensible or stretchable in at least one direction to an extent of at least 5%, in particular to at least 10% and preferably to at least 20%.

The textile fabric may have an area weight in the range from 25 to 500 g/m$^2$, in particular in the range from 50 to 300 g/m$^2$ and preferably in the range from 75 to 250 g/m$^2$. A person skilled in the art is always able to conform the corresponding area weights to the particular requirements.

The second glove section 3 or the textile sheetlike filtering material of the second glove section 3 may comprise an adsorbent for chemical poisons, in particular an adsorbent based on activated carbon, preferably in the form of particles of activated carbon and/or fibers of activated carbon. The adsorbent is preferably secured to the textile fabric, in particular as defined above, in particular by adhering. The securement or fixing of the adsorbent for poisonous or noxiant agents, preferably to the textile fabric, is effected in a manner known per se to one skilled in the art, for example by continuous or preferably discontinuous application of an adhesive to the textile fabric, the material adsorbing poisonous or noxiant agents subsequently being fixed to the textile fabric by means of the adhesive. Useful adhesives are known as such to one skilled in the art; adhesives which may be used include for example thickened polymeric dispersions, hotmelts or else reactive adhesives, in particular polyurethane-based one- or two-component systems, for example blocked prepolymeric diisocyanates which crosslink via di- or polyfunctional amines or alcohols. Adhesives which are breathable in the cured state, for example polyurethane-based adhesives, are advantageous for the purposes of the present invention.

To enhance the wear comfort, in particular to avoid any stiffness on the part of the textile sheetlike material, a discontinuous, in particular dotwise application of adhesive is preferred, i.e. the textile fabric is advantageously invested discontinuously or dotwise with the adsorbent for the poisonous or noxiant agents in a regular or irregular pattern or grid. Dotwise application of adhesive ensures that the softness, flexibility or extensibility and air perviousness of the textile fabric is preserved to a high degree. To achieve an efficient adsorptive performance, it is preferable for at least 50%, in particular at least 60% and more preferably at least 70% of the textile fabric to be invested with the adsorbent for the poisonous or noxiant agent. The amount of adhesive used should advantageously be chosen such that the adsorbent for poisonous or noxiant agents is at least 50%, in particular at least 60% and preferably at least 70% freely accessible for the poisonous or noxiant agents to be adsorbed, i.e. not fully pressed, or does not fully sink, into the adhesive.

Preferably, the adsorbent for poisonous and/or noxiant agents is disposed on that side of the second glove section 3 which faces away from the wearer in the worn state of the glove 1. In other words, the sheetlike textile construction of the second glove section 3 is preferably disposed on its inside surface. However, in accordance with the present invention, it is similarly possible for the adsorbent for poisonous and/or noxiant agents to be disposed on that side of the second glove section 3 which faces the wearer in the worn state of the glove 1.

The activated carbon preferably used as adsorbent for poisonous or noxiant agents may consist for example of discrete particles of activated carbon, preferably in grain form ("grainocarbon") or sphere form ("spherocarbon"). In this case, the average diameter of the particles of activated carbon is preferably less than 1.0 mm, in particular less than 0.8 mm and more preferably less than 0.6 mm, but is generally at least 0.1 mm. In this embodiment, the particles of activated carbon are advantageously present on the carrier material or the textile fabric (loading amount) in an amount in the range from 5 to 500 g/m$^2$, in particular in the range from 10 to 400 g/m$^2$, preferably in the range from 20 to 300 g/m$^2$, more preferably in the range from 25 to 250 g/m$^2$, even more preferably in the range from 50 to 150 g/m$^2$ and most preferably in the range from 50 to 100 g/m$^2$. Suitable particles of activated carbon have in particular an internal surface area (BET) of at least 800 m$^2$/g, in particular of at least 900 m$^2$/g, preferably of at least 1.000 m$^2$/g, more preferably in the range from 800 to 2.500 m$^2$/g. Grainocarbon, in particular spherocarbon, has the decisive advantage of being enormously abrasion resistant and very hard, which is of great importance with regard to the wear resistance properties. Preferably, the bursting pressure for an individual particle of activated carbon, in particular granule or spherule of activated carbon, is at least 5 newtons, in particular at least 10 newtons and can be up to 20 newtons.

In an alternative embodiment, the second glove section 3 or the textile fabric of the second glove section 3 is provided or invested with fibers of activated carbon, in particular in the form of an activated carbon fiber fabric. The area weight of such activated carbon fiber fabrics may be for example in the range from 10 to 300 g/m$^2$, in particular in the range from 20 to 200 g/m$^2$ and preferably in the range from 30 to 150 g/m$^2$. The activated carbon fiber fabric may be for example a woven, loop-formingly knitted, laid or bonded activated carbon fiber fabric, in particular on the basis of carbonized and activated cellulose or of a carbonized and activated acrylonitrile. In a particular embodiment, the second glove section 3 can consist essentially of the material adsorbing poisonous or noxiant agents, in particular of the fibers of activated carbon, preferably in the form of the aforementioned textile activated carbon fiber fabrics.

It is similarly possible to combine particles of activated carbon and fibers of activated carbon with each other. Particles of activated carbon have the advantage of a higher adsorptive capacity, whereas fibers of activated carbon possess better adsorption kinetics.

To increase the adsorption efficiency or performance, it is possible for the adsorbent to be provided or impregnated with at least one catalyst in a manner known per se to one skilled in the art. Catalysts useful for the purposes of the present invention include for example enzymes and/or metals, preferably copper, silver, cadmium, platinum, palladium, rhodium, zinc and/or mercury, in particular their ions and/or salts. The amount of catalyst can vary within wide limits; it is generally in the range from 0.05% to 12% by weight, preferably in the range from 1% to 10% by weight and more preferably in the range from 2% to 8% by weight, based on the weight of the adsorbent. The additional use of a catalyst leads to the activated carbon being relieved, so that the activated carbon does not become exhausted too quickly.

When an adsorbent based on activated carbon is used for adsorbing poisonous or noxiant agents, the good wear comfort properties of the present invention's glove 1 are additionally improved by the puffing of the activated carbon since the activated carbon serves as a moisture or water store or buffer (for hand perspiration for example). When for example particles of activated carbon in grain form ("grainocarbon") or sphere form ("spherocarbon") are used, an add-on of for example up to 250 g/m$^2$ or more is capable in the event of sweating for example of storing about 40 g/m$^2$ of moisture and then giving it off again to the outside.

It may additionally be provided in accordance with the present invention that the adsorbent for chemical poisons be covered on the outside with a further textile sheetlike material, in particular with a woven, loop-formingly knitted, loop-drawingly knitted, laid, bonded, batty or nonwoven fabric, to protect the adsorbent from external effects. When an additionally applied textile fabric is present on the outside surface, the second glove section 3 or the textile sheetlike filtering material of the second glove section 3 has a sandwich structure.

The air perviousness of the second glove section 3 may be more than 200 l/m$^2$ per second, preferably more than 300 l/m$^2$ per second, more preferably more than 400 l/m$^2$ per second, even more preferably more than 600 l/m$^2$ per second and most preferably more than 800 l/m$^2$ per second when measured according to DIN 53887. A high air perviousness is advantageous in particular because it ensures a high wear comfort.

Similarly, the water vapor perviousness of the second glove section 3 or of the textile fabric of the second glove section 3 leads to a high wear comfort with regard to the entire glove 1 of the present invention. To ensure a high wear comfort, the second glove section 3 of the present invention's glove 1 may have a water vapor transmission rate of at least 15 l/m$^2$ per 24 h, in particular 20 l/m$^2$ per 24 h, preferably at least 25 l/m$^2$ per 24 h, more preferably at least 30 l/m$^2$ per 24 h or even more (measured by the inverted cup method of ASTM E 96 and at 25° C.) (for further details concerning the measurement of the water vapor transmission rate, WVTR, cf. also McCullough et al. "A comparison of standard methods for measuring water vapor permeability of fabrics" in *Meas. Sci. Technol. [Measurements Science and Technology]* 14, 1402-1408, August 2003). This, as shown, ensures a particularly high wear comfort, since perspiration, in particular hand perspiration, can be transported away effectively.

To ensure a high wear comfort, the second glove section 3 or the textile fabric of the second glove section 3 may also have a water vapor transmission rate $R_t$ under steadystate conditions—measured according to DIN EN 31 092:1993 of February 1994 ("Textiles—Physiological Effects, Measurement of Heat and Water Vapor Transition Resistance Under Steadystate Conditions (sweating guarded-hotplate test)") or according to the equivalent international standard ISO 11092—at 35° C. of not more than 20 m·pascal/watt, in particular not more than 15 m$^2$·pascal/watt, preferably not more than 10 m$^2$·pascal/watt and more preferably not more than 5 m$^2$·pascal/watt.

The specific configuration of the second glove section 3 thus, as well as a high wear comfort, provides an excellent protection against poisonous and noxiant agents, since the second glove section 3 prevents or at least retards the passage of gaseous poisonous or noxiant agents in particular, so that the glove 1 of the present invention as a whole possesses excellent protective properties against the aforementioned toxic substances.

The present invention's glove 1, combining in particular a good protective effect against poisonous and/or noxiant agents with a high water vapor and air perviousness, provides a permeation resistance with regard to chemical warfare agents, in particular bis[2-chloroethyl]sulphide (also known by the synonyms of mustard gas, Hd or Yellow Cross), measured according to CRDEC-SP-84010, method 2.2, allowing the passage of not more than 4 μg/cm$^2$ per 24 h, in particular not more than 3.5 μg/cm$^2$ per 24 h, preferably not more than 3.0 μg/cm$^2$ per 24 h and more preferably not more than 2.5 μg/cm$^2$ per 24 h. This makes it possible to achieve an extremely high protection against poisonous or warfare agents.

It may finally be provided that the glove 1 of the present invention has a connecting element, in particular a preferably elastic terminating band. This prevents any slippage of the present invention's glove 1 and ensures improved protection against poisonous or noxiant agents due to the additional seal-off effect. In accordance with the present invention, the joining element can be similarly and nonlimitingly be constructed as a zip or touch and close fastener, whereby effective and secure joining to other items of clothing, for example jackets, shirts and the like, can be achieved. The present invention's glove 1 can thus be an integral constituent of a (whole body) protective suit for example.

The present invention's glove can be produced in a conventional manner. This will be very well known to one skilled in the art of manufacturing gloves, so that no further observations are required in this regard.

The glove of the present invention has numerous advantages, of which the present ones shall be specified purely by way of example:

- The protective glove of the present invention possesses an excellent protective function against poisonous or warfare agents of any kind, while at the same time ensuring good wear comfort due to the excellent breathability. Moisture, in particular in the form of hand perspiration, can thus be effectively removed from the hand even under high physical exertion. The skin thus remains pleasantly dry even under high physical exertion, so that the skin does not in particular go all soggy.
- The glove of the present invention has protective properties specifically adapted or tailored to the performance requirement profile, so that altogether optimal protective performance coupled with simultaneously high wear comfort results. The simultaneous realization of the diametrically opposed properties of a high protective effect on the one hand and good breathability on the other are achieved in the present invention as a result of the glove comprising two differently configured glove sections each having protective properties specifically adapted to the performance requirement profile.
- The material of the first glove section is specifically configured to be at least essentially impervious to chemical poisonous or warfare agents or at least retard their passage and provides a particularly high protective effect against highly concentrated or liquid poisonous or noxiant agents in particular.
- The gas and water vapor perviousness and simultaneous protective function against poisonous or noxiant agents on the part of the second glove section ensures that the glove of the present invention provides altogether a very high wear comfort while at the same time affording high protection against poisonous or warfare agents.
- To improve grip, the first glove section may additionally be provided on its outside surface with pimples and/or with a surface roughening, so that the grip offered by the glove of the present invention can be significantly enhanced as a result.
- The protective glove of the present invention consists merely of two glove sections, so that the number of joins and thus the number of potential breakthrough points is reduced. The low number of pieces of material simultaneously makes for inexpensive manufacture of the glove of the present invention.

The seamless construction of the hand's inner surface, the inner surfaces of the fingers and also of the fingertips means that the glove of the present invention does not have any troublesome seams in the grip region and thus offers excellent tactility.

The aforementioned properties particularly qualify the glove of the present invention for military deployment or NBC deployment (for example in the form of a military glove) or for example for decontamination duty or for handling highly toxic substances in the industrial sector for example (for example in the form of a laboratory or worker's glove).

Further elaborations, modifications and variations of the present invention will become apparent and realizable by the ordinarily skilled after reading the description without their having to go outside the realm of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A glove for covering a hand's inside surface, a hand's outside surface and a hand's fingers, the glove affording protective function against poisonous and/or noxiant agents, wherein said glove comprising:

two mutually connected glove sections, which two glove sections are constructed of different materials;

a first glove section being formed of a polymer-based material which is constructed and arranged to retard the passage of chemical poisons and warfare agents and is gas-impervious and water-impervious wherein the first glove section covers the hand's inside surface and the inside surfaces of the fingers in the worn state of the glove; and a second glove section being formed of a textile sheetlike filtering material which prevents or at least retards the passage of chemical poisons and warfare agents and is air-pervious and water-vapor-pervious, wherein the second glove section covers at least a portion of the back of the hand in the worn state of the glove and wherein the second glove section comprises an adsorbent for poisonous and noxiant agents on the basis of activated carbon, wherein the glove comprises a shaft for the wrist and for the forearm section adjoining the wrist, wherein the shaft is formed by the second glove section only.

2. The glove according to claim 1, wherein the first glove section covers the free ends of the fingers over the entire finger circumference in the worn state of the glove.

3. The glove according to claim 1, wherein the first glove section covers the inner surfaces of the fingers and the longitudinal sides of the fingers at least essentially completely in the worn state of the glove.

4. The glove according to claim 1, wherein the first glove section covers the fingers at least essentially completely in the worn state of the glove.

5. The glove according to claim 1, wherein the second glove section covers the backs of the fingers in the worn state of the glove.

6. The glove according to claim 1, wherein the first glove section covers at least a portion of the back of the hand comprising a region of the back of the hand that is adjacent to the fingers, in the worn state of the glove (1).

7. The glove according to claim 1, wherein the second glove section covers the back of the hand.

8. The glove according to claim 1, wherein the second glove section covers a portion of the back of the hand, comprising a region of the back of the hand that is not adjacent to the fingers, in the worn state of the glove.

9. The glove according to claim 1, wherein the first glove section and the second glove section each have a one-piece-construction.

10. The glove according to claim 1, wherein the first glove section and the second glove section are stitched, adhered or welded together and wherein the first glove section and the second glove section are connected to each other sealingly.

11. The glove according to claim 1, wherein the material of the first glove section is at least essentially pore-free and aperture-free and continuous.

12. The glove according to claim 1, wherein the material of the first glove section comprises at least one polymer material.

13. The glove according to claim 12, wherein the polymer material comprises at least one rubber and/or at least one fluoroelastomer.

14. The glove according to claim 13, wherein the rubber is a modified butyl rubber.

15. The glove according to claim 1, wherein the material of the first glove section has a multilayered construction comprising at least two layers, wherein the layers each comprise different polymers.

16. The glove according to claim 15, wherein at least one layer of the multilayer construction comprises an optionally modified rubber, in particular an optionally modified butyl rubber, and at least one other layer of the multilayer construction comprises at least one fluoroelastomer.

17. The glove according to claim 1, wherein the first glove section additionally comprises on its inside surface a textile fabric.

18. The glove according to claim 1, wherein the adsorbent comprises activated carbon particles and/or activated carbon fibers.

19. The glove according to claim 1, wherein the adsorbent is fixed to a sheetlike textile fabric.

20. A glove for covering a hand's inside surface, a hand's outside surface, and a hand's fingers, the glove affording protective function against poisonous and/or noxiant agents, wherein said glove comprising:

two mutually connected glove sections, which two glove sections are constructed of different materials;

a first glove section being formed of a polymer-based material which is impervious to chemical poisons and warfare agents and is gas-impervious and water-impervious, wherein the first glove section covers the hand's inside surface and the inside surfaces of the fingers in the worn state of the glove; and a second glove section being formed of a textile sheetlike filtering material which prevents or at least retards the passage of chemical poisons and warfare agents and is air-pervious and water-vapor-pervious, wherein the second glove section covers at least a portion of the back of the hand in the worn state of the glove and wherein the second glove section comprises an adsorbent for poisonous and noxiant agents on the basis of activated carbon, wherein the glove comprises a shaft for the wrist and for the forearm section adjoining the wrist, wherein the shaft is formed by the second glove section only.

* * * * *